US006830701B2

(12) United States Patent
DeBar et al.

(10) Patent No.: US 6,830,701 B2
(45) Date of Patent: Dec. 14, 2004

(54) METHOD FOR FABRICATING MICROELECTROMECHANICAL STRUCTURES FOR LIQUID EMISSION DEVICES

(75) Inventors: Michael J. DeBar, Rochester, NY (US); Christopher N. Delametter, Rochester, NY (US); Edward P. Furlani, Lancaster, NY (US)

(73) Assignee: Eastman Kodak Company, Rochester, NY (US)

( * ) Notice: Subject to any disclaimer, the term of this patent is extended or adjusted under 35 U.S.C. 154(b) by 177 days.

(21) Appl. No.: 10/191,506

(22) Filed: Jul. 9, 2002

(65) Prior Publication Data

US 2004/0008238 A1 Jan. 15, 2004

(51) Int. Cl.[7] ..... B41J 2/04; B41J 2/045; C23F 1/00

(52) U.S. Cl. ..... 216/27; 216/2; 216/57; 347/44; 347/54; 29/980.1

(58) Field of Search ..... 216/2, 27, 57; 347/44, 54; 29/890.1

(56) References Cited

U.S. PATENT DOCUMENTS

| | | | | |
|---|---|---|---|---|
| 4,520,375 A | * | 5/1985 | Kroll | 347/54 |
| 4,908,679 A | | 3/1990 | Vora et al. | 357/15 |
| 5,051,643 A | * | 9/1991 | Dworsky et al. | 310/309 |
| 5,300,444 A | | 4/1994 | Hachisuka et al. | 437/29 |
| 5,644,341 A | | 7/1997 | Fujii et al. | 347/11 |
| 5,668,579 A | | 9/1997 | Fujii et al. | 347/10 |
| 5,739,831 A | | 4/1998 | Nakamura et al. | 437/51 |
| 5,798,283 A | | 8/1998 | Montague et al. | 438/24 |
| 5,804,084 A | | 9/1998 | Nasby et al. | 216/2 |
| 5,890,745 A | | 4/1999 | Kovacs | 285/24 |
| 5,907,791 A | | 5/1999 | Cappuzzo et al. | |
| 6,082,208 A | | 7/2000 | Rodgers et al. | 74/406 |
| 6,127,198 A | | 10/2000 | Coleman et al. | 438/21 |
| 6,174,820 B1 | | 1/2001 | Habermehl et al. | 438/745 |
| 6,318,841 B1 | | 11/2001 | Coleman et al. | 347/44 |
| 6,345,884 B1 | | 2/2002 | Yoon et al. | 347/54 |
| 6,357,865 B1 | | 3/2002 | Kubby et al. | 347/68 |
| 6,527,373 B1 | * | 3/2003 | Delametter et al. | 347/54 |
| 2001/0023523 A1 | | 9/2001 | Kubby et al. | 347/68 |
| 2004/0008238 A1 | * | 1/2004 | DeBar et al. | 347/44 |
| 2004/0036740 A1 | * | 2/2004 | Hawkins et al. | 347/54 |
| 2004/0041884 A1 | * | 3/2004 | DeBar et al. | 347/55 |

FOREIGN PATENT DOCUMENTS

| | | |
|---|---|---|
| WO | WO 90/09677 | 8/1990 |

* cited by examiner

*Primary Examiner*—Jeffrie R. Lund
(74) *Attorney, Agent, or Firm*—Milton S. Sales

(57) ABSTRACT

An actuator is made by depositing an electrode layer on an initial layer. A patterned layer of sacrificial material is formed on the first electrode layer such that a region of the first electrode layer is exposed through the subsequent layer. A second electrode layer is deposited and patterned on the subsequent layer. Then, a third patterned layer of sacrificial material is formed on the second electrode layer with an opening there through to the exposed region of the first electrode layer. A structure is deposited, patterned and planarized on the third layer expose a surface of the third layer. A third electrode layer is deposited and patterned on the planarized structure and the exposed surface of the third layer. The sacrificial material is partially removed, whereby the first electrode layer, the structure, and the third electrode layer are free to move together relative to the second electrode layer.

4 Claims, 16 Drawing Sheets

METHOD FOR FABRICATING MICROELECTROMECHANICAL STRUCTURES FOR LIQUID EMISSION DEVICES

CROSS-REFERENCE TO RELATED APPLICATIONS

Reference is made to commonly assigned, co-pending U.S. patent application Ser. No. 10/122,566 entitled DROP-ON-DEMAND LIQUID EMISSION USING INTERCONNECTED DUAL ELECTRODES AS EJECTION DEVICE filed in the names of Christopher N. Delametter et al. on Apr. 15, 2002.

FIELD OF THE INVENTION

The present invention relates generally to microelectromechanical (MEM) devices. The invention is thought to be advantageous when producing drop-on-demand liquid emission devices such as, for example, ink jet printers, and more particularly such devices which employ an electrostatic actuator for driving liquid from the device.

BACKGROUND OF THE INVENTION

Drop-on-demand (DOD) liquid emission devices with electrostatic actuators are known for ink printing systems. U.S. Pat. Nos. 5,644,341 and 5,668,579, which issued to Fujii et al. on Jul. 1, 1997 and Sep. 16, 1997, respectively, disclose such devices having electrostatic actuators composed of a diaphragm and opposed electrode. The diaphragm is distorted by application of a first voltage to the electrode. Relaxation of the diaphragm expels an ink droplet from the device. Other devices that operate on the principle of electrostatic attraction are disclosed in U.S. Pat. Nos. 5,739,831, 6,127,198, and 6,318,841; and in U.S. Publication No. 2001/0023523.

U.S. Pat. No. 6,345,884, teaches a device having an electrostatically deformable membrane with an ink refill hole in the membrane. An electric field applied across the ink deflects the membrane and expels an ink drop.

IEEE Conference Proceeding "MEMS 1998," held Jan. 25–29, 2002 in Heidelberg, Germany, entitled "A Low Power, Small, Electrostatically-Driven Commercial Inkjet Head" by S. Darmisuki, et al., discloses a head made by anodically bonding three substrates, two of glass and one of silicon, to form an ink ejector. Drops from an ink cavity are expelled through an orifice in the top glass plate when a membrane formed in the silicon substrate is first pulled down to contact a conductor on the lower glass plate and subsequently released. There is no electric field in the ink.

U.S. Pat. No. 6,357,865 by J. Kubby et al. teaches a surface micromachined drop ejector made with deposited polysilicon layers. Drops from an ink cavity are expelled through an orifice in an upper polysilicon layer when a lower polysilicon layer is first pulled down to contact a conductor and is subsequently released.

One such device is disclosed in co-pending U.S. patent application Ser. No. 10/122,566 entitled DROP-ON-DEMAND LIQUID EMISSION USING INTERCONNECTED DUAL ELECTRODES AS EJECTION DEVICE filed in the names of Christopher N. Delametter et al. on Apr. 15, 2002. That device includes a liquid chamber having a nozzle orifice. Separately addressable dual electrodes are positioned on opposite sides of a stationary central electrode such that the three electrodes are generally axially aligned with the nozzle orifice. The two addressable electrodes are structurally connected via a rigid, electrically insulating coupler. To eject a drop, an electrostatic voltage is applied to the addressable electrode nearest to the nozzle orifice, which pulls that electrode toward the central electrode and away from the orifice so as to draw liquid into the expanding chamber. Subsequently, the other addressable electrode is energized, pressurizing the liquid in the chamber behind the nozzle orifice and causing a drop to be ejected from the nozzle orifice.

SUMMARY OF THE INVENTION

The device described in the Delametter et al. patent application, and other multi-layer microelectromechanical electrostatic actuators for liquid emission devices, can be manufactured by chemical mechanical polishing in combination with a sacrificial layer to produce a planar surface with a non-sacrificial material that can move within a trench left when the sacrificial layer is removed to provide a separation from stationary parts.

According to a feature of the present invention, a multi-layer microelectromechanical electrostatic actuator for producing drop-on-demand liquid emission devices is made by forming an initial patterned layer of sacrificial material on a substrate. A first electrode layer is deposited and patterned on the initial layer at a position opposed to the substrate. Next, a subsequent patterned layer of sacrificial material is formed on the first electrode layer such that a region of the first electrode layer is exposed through the subsequent layer of sacrificial material. A second electrode layer is deposited and patterned on the subsequent layer of sacrificial material at a position opposed to the first electrode layer. Then, a third patterned layer of sacrificial material is formed on the second electrode layer, the third layer of sacrificial material having an opening there through to the exposed region of the first electrode layer. A structure is deposited and patterned on the third layer of sacrificial material to a depth to at least fill the opening through the third layer of sacrificial material. Next, the structure is planarized to expose a surface of the third layer of sacrificial material. A third electrode layer is deposited and patterned on the planarized structure and the exposed surface of the third layer of sacrificial material, whereby the first electrode layer and the third electrode layer are attached by the structure. Finally, the sacrificial material is removed from the initial layer, the subsequent layer, and the third layer, whereby the first electrode layer, the structure, and the third electrode layer are free to move together relative to the second electrode layer.

DETAILED DESCRIPTION OF THE INVENTION

As described in detail herein below, the present invention provides a method for fabricating MEM devices. The invention is thought to be advantageous when producing drop-on-demand liquid emission devices which employ an electrostatic actuator for driving liquid from the device. The most familiar of such devices are used as printheads in ink jet printing systems. Many other applications are emerging which make use of devices similar to ink jet printheads, but which emit liquids (other than inks) that need to be finely metered and deposited with high spatial precision.

Figure 1:
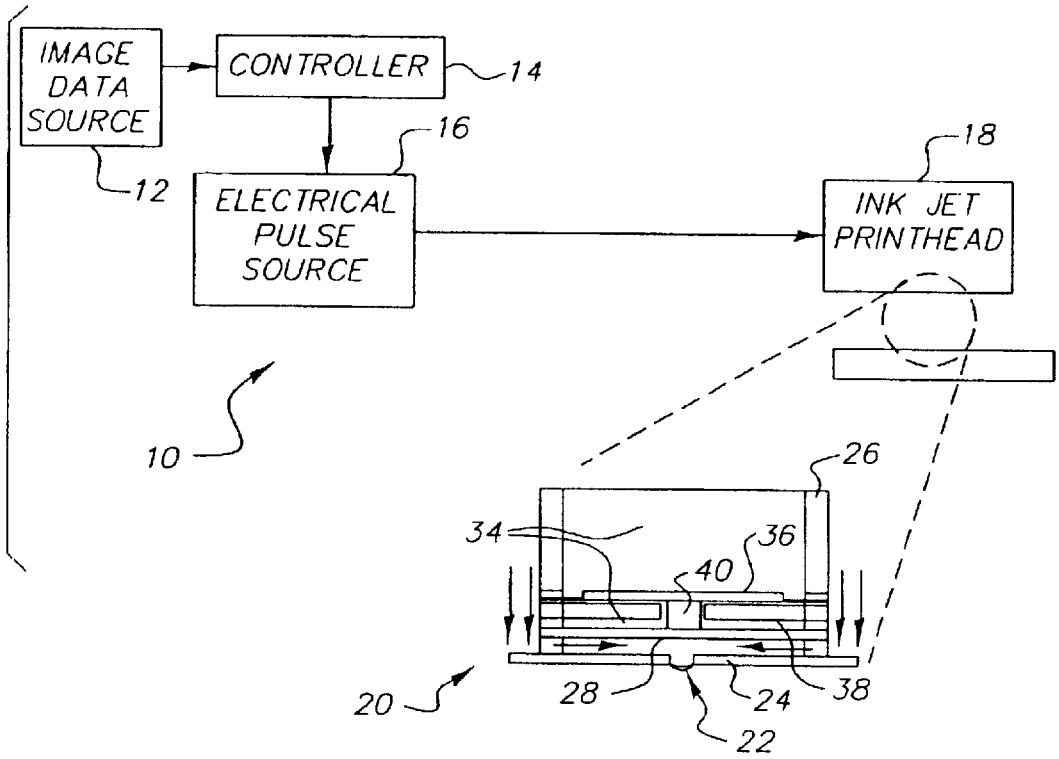
FIG. 1 is a schematic illustration of a liquid emission device.

FIG. 1 shows a schematic representation of a liquid emission device 10, such as an ink jet printer, which includes an electrostatic actuator fabricated in a manner according to the present invention. The system includes a source 12 of data (say, image data) which provides signals that are interpreted by a controller 14 as being commands to emit drops. Controller 14 outputs signals to a source 16 of electrical energy pulses which are inputted to a liquid emission device such as an ink jet printer 18.

Figure 2:
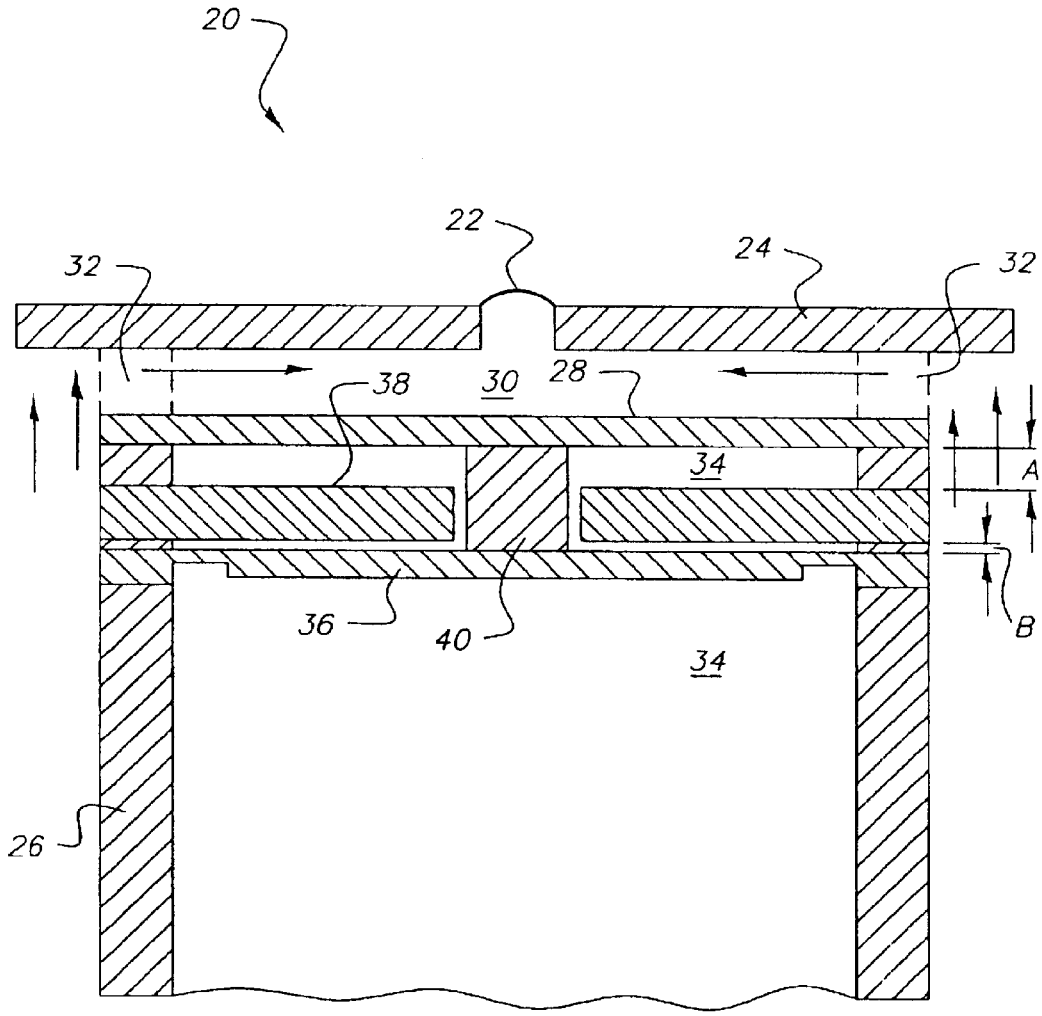
FIG. 2 is a schematic cross-sectional view of a portion of the liquid emission device of FIG. 1, a portion of which is particularly suitable for manufacture by the method of the present invention.
Figure 25:
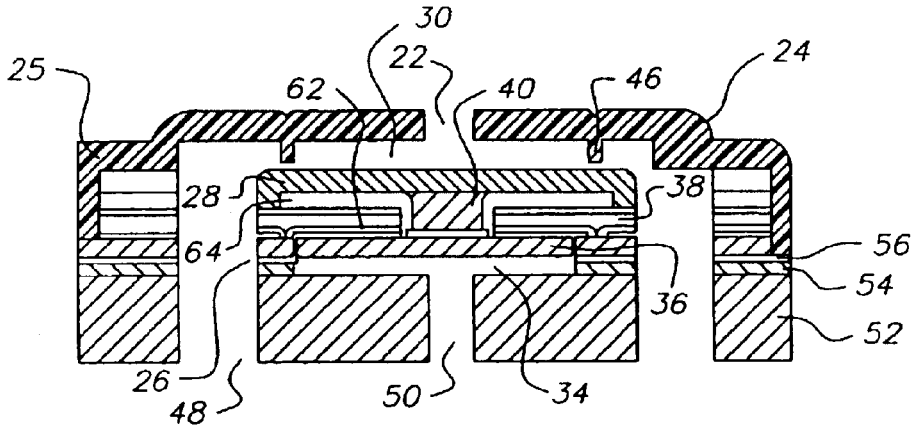
FIG. 25 shows a cross-section through D–D' of FIG. 8.

Liquid emission device 10 includes a plurality of electrostatic drop ejection mechanisms 20. FIG. 2 is a cross-sectional view of one of the plurality of electrostatically actuated drop ejection mechanisms 20. A nozzle orifice 22 is formed in a nozzle plate 24 for each mechanism 20. A wall or walls 26 that carry an electrically addressable electrode 28 bound each drop ejection mechanism 20. The wall may comprise a single amterial as shown in FIG. 2, or may comprise a stack of material layers, as shown in FIG. 25. A portion of electrode 28 is sealingly attached to outer wall 25 to define a liquid chamber 30 adapted to receive the liquid to be ejected from nozzle orifice 22. The liquid is drawn into chamber 30 through one or more ports 32 from a supply, not shown. Dielectric fluid, preferably air, fills the region 34 on the side of electrode 28 opposed to chamber 30.

A second electrode 36 is electrically addressable separately from electrode 28. Addressable electrodes 28 and 36 are preferably at least partially flexible and are positioned on opposite sides of a single central electrode 38. Addressable electrode 36 is illustrated with a peripheral region that has enhanced flexibility. Since there is no need for addressable electrode to completely seal with wall 26, the peripheral region may be mere tabs tethering the central region of electrode 36 to wall 26.

Central electrode 38 is structurally stiff, and the two addressable electrodes are structurally connected via a rigid coupler 40. This coupler is electrically insulating and ties the two addressable electrodes structurally together. There is a gap "A" between addressable electrode 28 and central electrode 38 and a gap "B" between addressable electrode 36 and central electrode 38.

Figure 5:
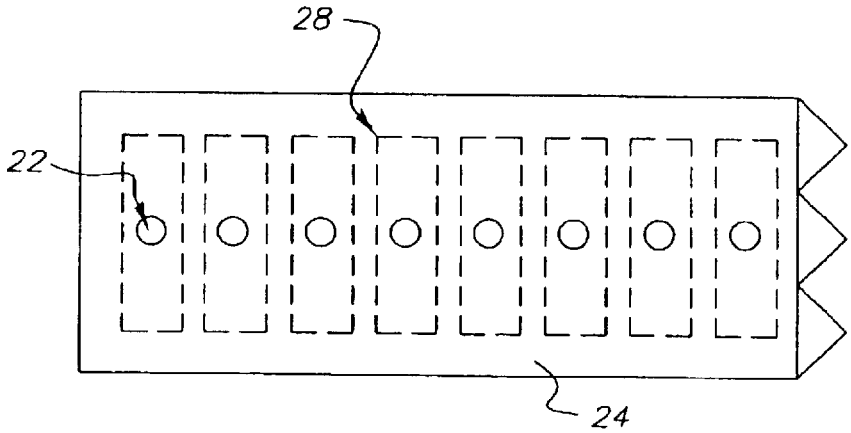
FIGS. 3–5 are top plan schematic views of alternative embodiments of a nozzle plate of the liquid emission device of FIGS. 1 and 2.
Figure 3:
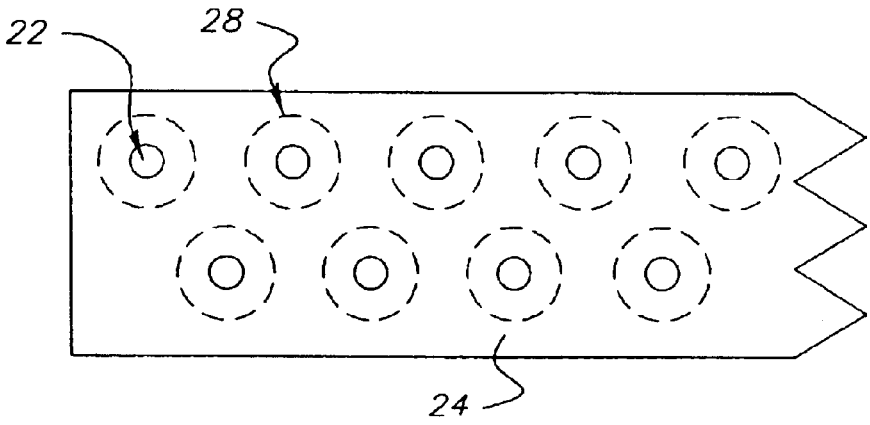
Figure 4:
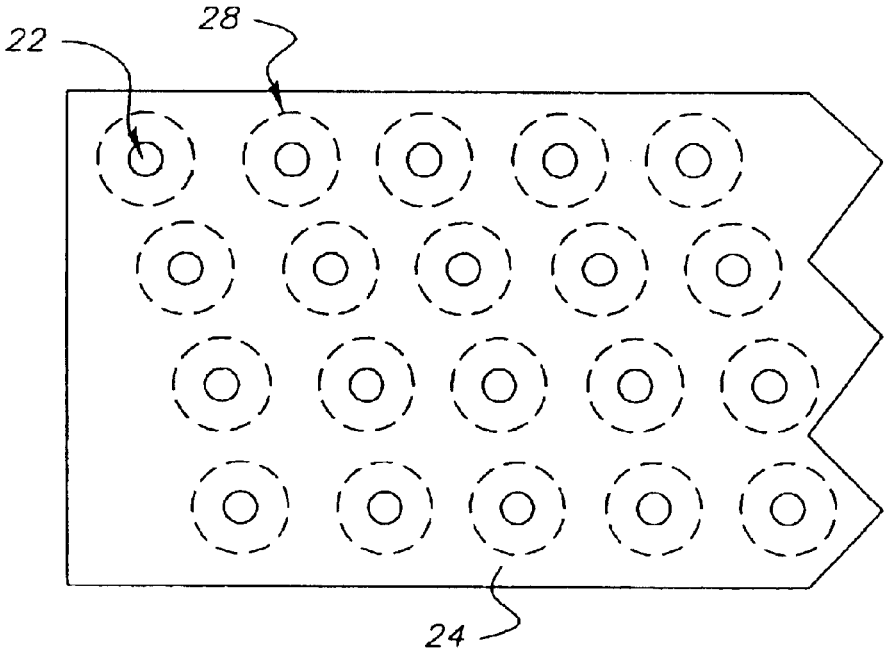

FIGS. 3–5 are top plan views of nozzle plate 24, showing several alternative embodiments of layout patterns for the several nozzle orifices 22 of a print head. Note that in FIGS. 2 and 3, the interior surface of walls 26 are annular, while in FIG. 5, walls 26 form rectangular chambers. Other shapes are of course possible, and these drawings are merely intended to convey the understanding that alternatives are possible within the spirit and scope of the present invention.

Figure 6:
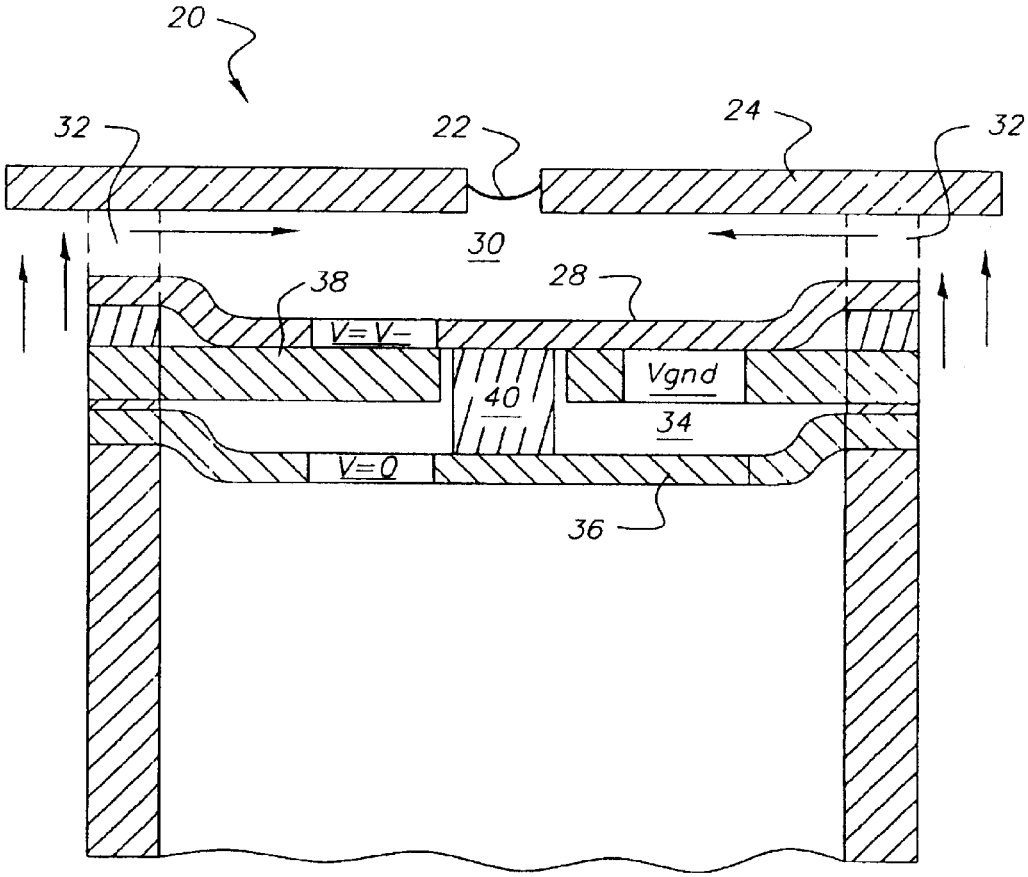
FIG. 6 is a cross-sectional schematic view of the liquid emission device of FIG. 2 shown in a first actuation stage.

Referring to FIG. 6, to eject a drop, a voltage difference is applied between the addressable electrode 28 nearest nozzle orifice 22 and the central electrode 38. This pulls electrode 28 toward central electrode 38 and away from the nozzle orifice, expanding chamber 30 and drawing liquid into the expanding chamber through ports 32. Addressable electrode 36 does not receive an electrostatic voltage, and moves in conjunction with addressable electrode 28, storing elastic potential energy in the system.

Figure 7:
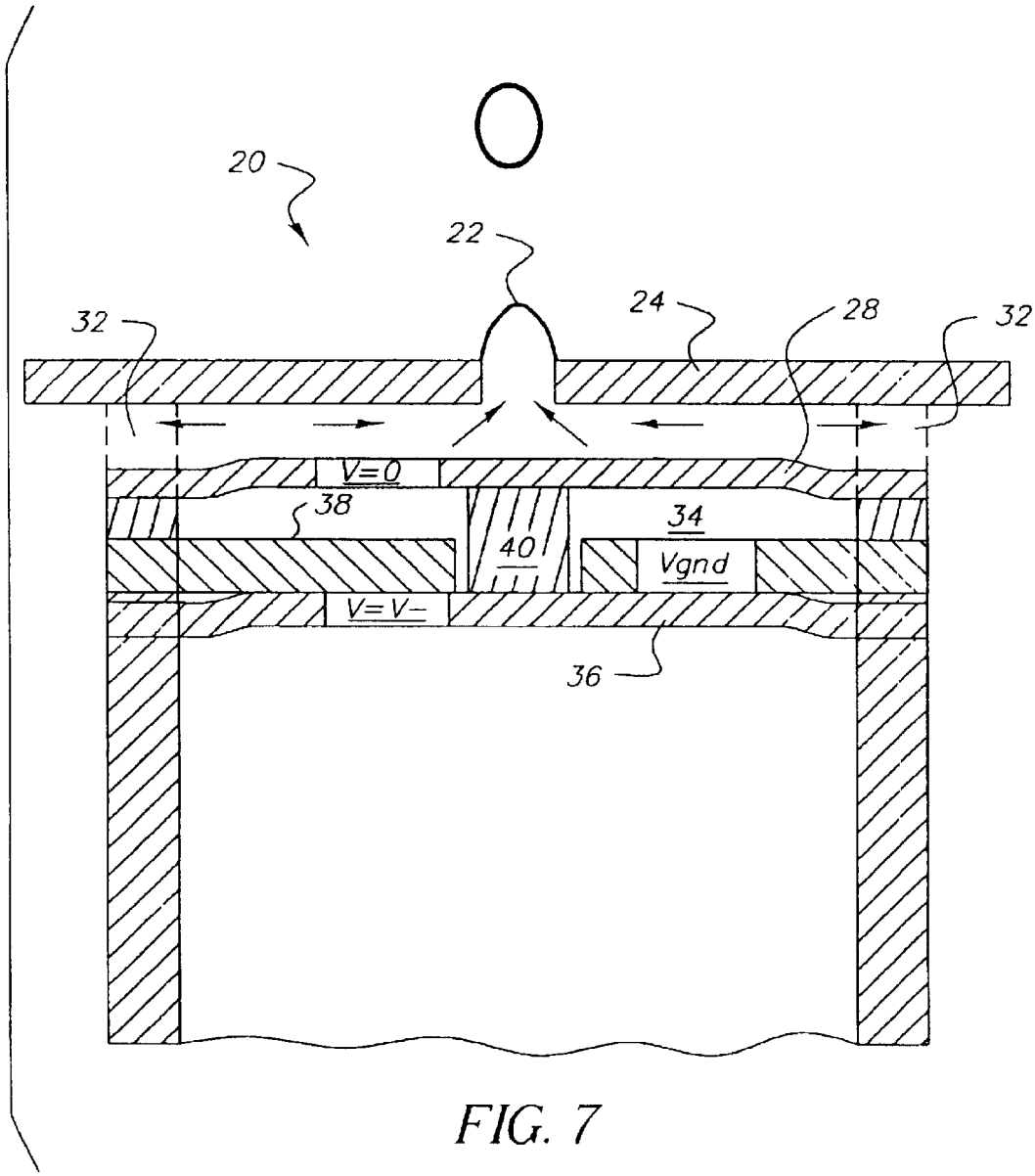
FIG. 7 is a cross-sectional schematic view of the liquid emission device of FIG. 2 shown in a second actuation stage.

Subsequently (say, several microseconds later) addressable electrode 28 is de-energized, that is, the potential difference between electrode 28 and 38 is made zero, and addressable electrode 36 is energized by imposing a voltage difference between electrodes 36 and 38, causing addressable electrode 36 to be pulled toward central electrode 38 in conjunction with the release of the stored elastic potential energy so that the structure begins to move from the position illustrated in FIG. 6 toward the position illustrated in FIG. 7. This pressurizes the liquid in chamber 30 behind the nozzle orifice, causing a drop to be ejected from the nozzle orifice.

The apparatus of FIGS. 1–7 are illustrated schematically. In FIGS. 8–28, the same apparatus is illustrated somewhat more realistically, although still in schematic form. The same reference numerals are used in FIGS. 8–28 as are used in FIGS. 1–7 to denote elements common to both sets of figures. It should be appreciated that cross-sections are not to scale in any of the figures. Devices made in accordance with the present invention may be a total of, say, 10–20 $\mu$m thick, excluding the substrate 52, and 100–300 $\mu$m across per device, with some layers as thin as 0.1 $\mu$m. Horizontal lengths are generally drawn in proportion to one another, and vertical lengths are drawn in proportion to one another, but vertical lengths are exaggerated to show features of interest that would not be seen if the horizontal and vertical scales were identical (i.e. the figures are stretched in the direction normal to the substrate surface to make thin layers distinguishable).

Figure 8:
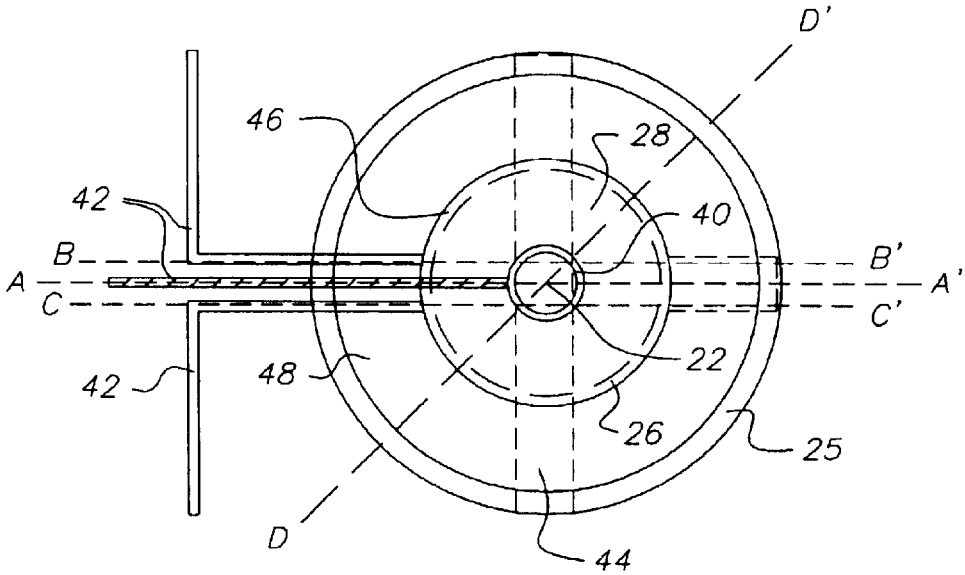
FIG. 8 is a top view of a portion of another embodiment of the liquid emission device of FIG. 1.

FIG. 8 is a top view of a portion of drop ejection mechanism 20 of FIG. 2 formed according to a preferred embodiment of the present invention. In this and the following figures, the structure continues to be illustrated in schematic form, but in somewhat more detail than in the previous figures.

Still referring to FIG. 8, during operation, electrical signals are sent via electrical leads 42 to the three electrodes 28, 36 and 38 of FIG. 2. The three-layer electrode structure is anchored to outer wall 26 by structural supports 44. Both the outer wall 25 and structural supports 44 may either comprise a single layer or comprise a stack of material layers as shown in FIG. 25. Rigid coupler 40 connects electrodes 28 and 36 of the three-layer electrode structure. A flow restrictor 46 prevents fluid from returning from liquid chamber 30 to the fluid reservoir (not visible here) via a fluid conduit 48 during drop ejection. A second fluid path 50 shown in FIG. 21 allows the dielectric fluid in region 34 to flow into and out of a dielectric fluid reservoir (not shown). In the preferred embodiment, the dielectric fluid is air, and the ambient atmosphere performs the function of a dielectric fluid reservoir.

A line A–A' in FIG. 8 indicates the plane of the cross-sections depicted in FIGS. 9–22, which illustrate a single drop ejector of many which would normally be batch fabricated simultaneously.

Figure 9:
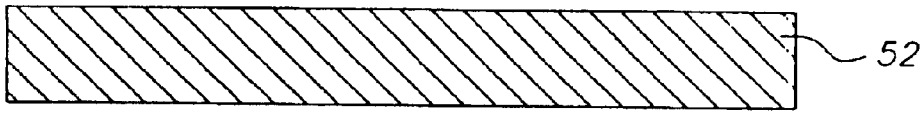
FIGS. 9–22 are cross-sectional views taken along line A–A' of FIG. 8 and showing the sequence of fabrication of a drop ejector.

FIG. 9 shows a substrate 52 of, say, a 550 $\mu$m thick single crystal silicon wafer for example. The substrate will be used to support the electrode structure and to form fluid conduits 48 that bring the fluid to nozzle orifice 22, and the second fluid paths 50 that bring the dielectric fluid to region 34.

Figure 10:
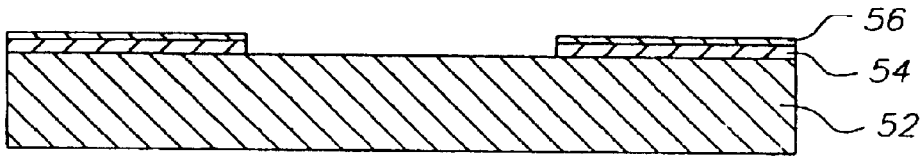

FIG. 10 shows the preferred embodiment after deposition, patterning, and etching of a first structural layer 54 (e.g. 0.75 μm thick doped polysilicon) and a first passivation layer 56 formed for example of 0.1 μm low pressure chemical vapor deposition (LPCVD) silicon nitride. These two layers are patterned using photolithography and etched away to form a depression that will allow addressable electrode 36 to deform toward substrate 52 during pullback. First passivation layer 56 insulates addressable electrode 36 from first structural layer 54 and substrate 52, which may both be formed of conductive materials.

Figure 11:
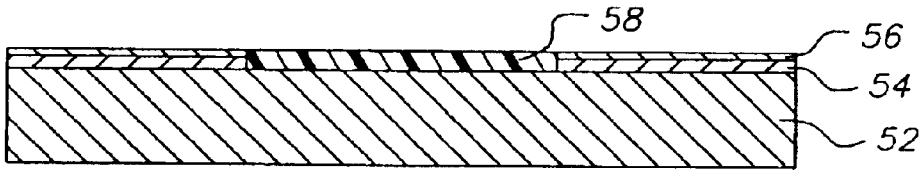
Figure 12:
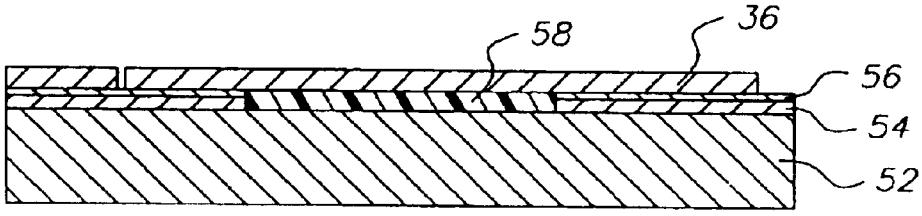
Figure 13:
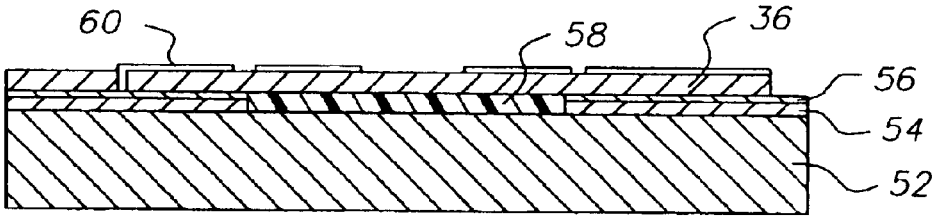

In FIG. 11, conformal deposition and planarization by chemical mechanical polishing (CMP) of an initial sacrificial layer 58 has occurred. The Sacrificial layer may be, for example, 0.85 μm plasma enhanced chemical vapor deposition (PECVD) silicon dioxide, filling in the depression formed during the previous etch and providing a planar surface for the deposition of addressable electrode 36 as shown in FIG. 12. Addressable electrode 36 maybe 3 μm to 5 μm doped polysilicon, and is relatively thick for a microdevice because it is FIG. 13 shows the preferred embodiment after deposition, patterning, and etching of a subsequent sacrificial layer 60 (e.g. 0.1 μm silicon dioxide). This thin layer provides mechanical separation between addressable electrode 36 and central electrode 38 shown in FIG. 15. Where subsequent sacrificial layer 60 is eliminated, the layers above will be attached to the layers below. The hole etched in the center will allow addressable electrode 36 and addressable electrode 28 can be mechanically coupled. The hole is preferably etched in the center, but could be etched elsewhere.

Figure 14:
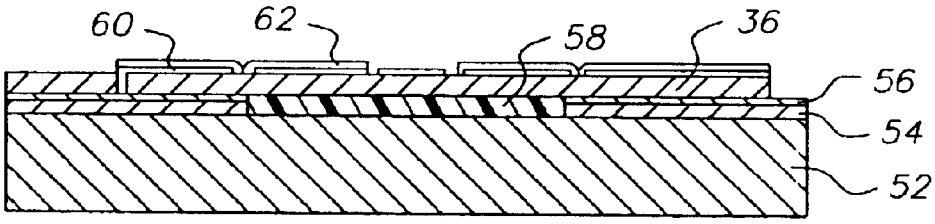

FIG. 14 shows the preferred embodiment after deposition, patterning, and etching of a second passivation layer 62 (e.g. 0.1 μm LPCVD silicon nitride). This layer provides electrical separation between addressable electrode 36 and central electrode 38, FIG. 15. LPCVD nitride is preferable to PECVD nitride in this layer, since the breakdown voltage of LPCVD nitride is higher, allowing a larger voltage to be supported without current leakage for the same layer thickness.

Figure 15:
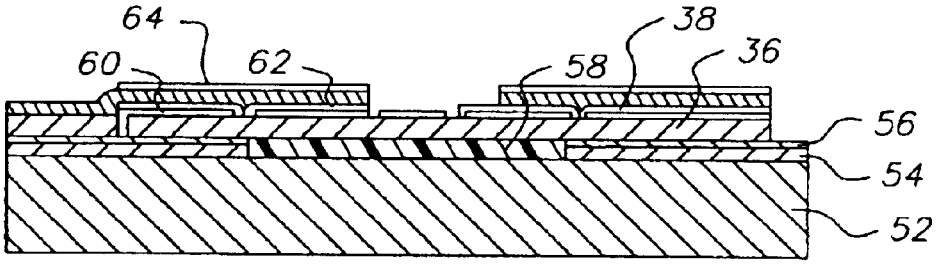
Figure 16A:
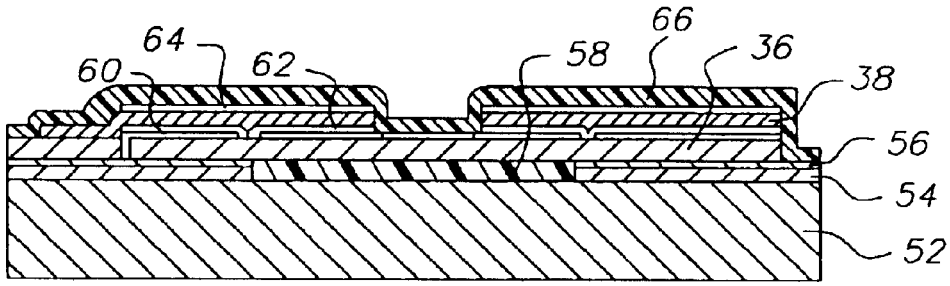
Figure 16B:
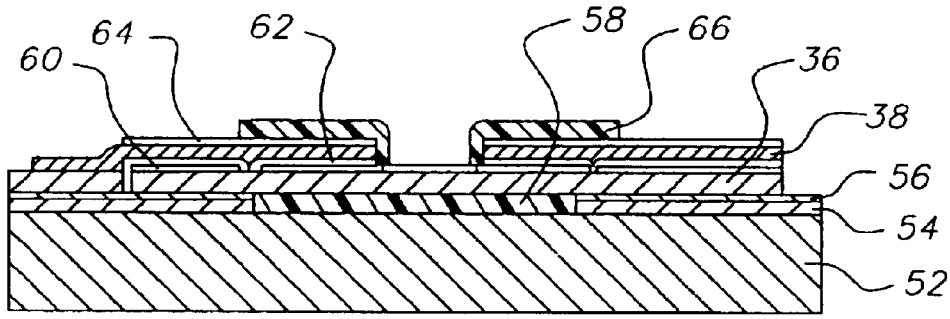

FIG. 15 shows the sequence for deposition, patterning, and etching of central electrode 38 (e.g. 5 μm doped polysilicon) and a third passivation layer 64 (e.g. 0.1 μm LPCVD silicon nitride). FIGS. 16*a* and 16*b* show the preferred embodiment after deposition, patterning, and etching of a third sacrificial layer 66 (e.g. 0.55 μm silicon dioxide). This layer provides mechanical separation between central electrode 38 and addressable electrode 28, as well as separation between rigid coupler 40 (FIG. 17*b*) and the central electrode 38. The patterning of the third sacrificial layer also removes part of the second sacrificial layer and exposes part of the first electrode.

Figure 17A:
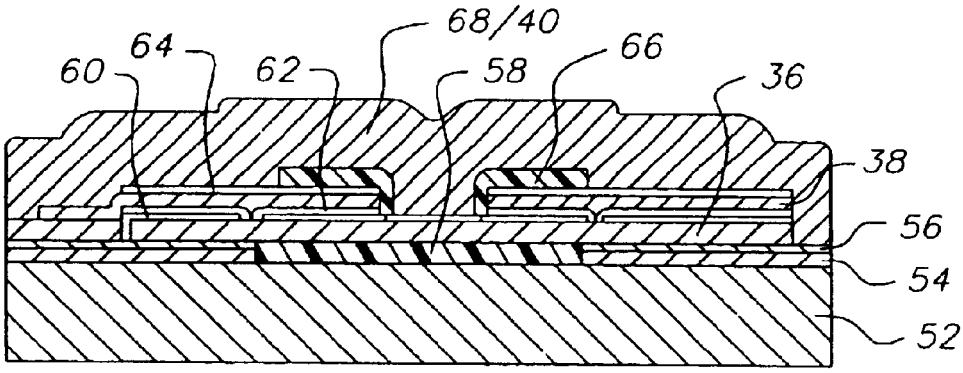
Figure 17B:
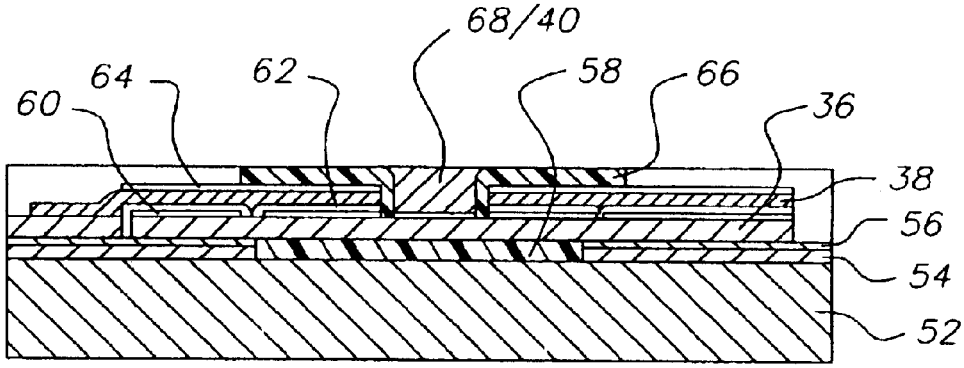
Figure 17C:
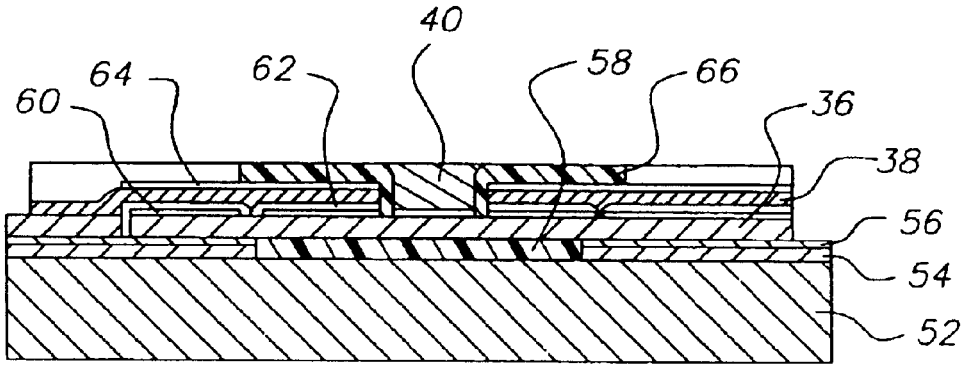

FIGS. 17*a*–17*c* show the sequence for deposition, planarization (e.g. CMP), patterning, and etching of a fourth passivation layer 68 (e.g. 5 μm silicon nitride). This layer forms the rigid coupler 40 that mechanically couples addressable electrode 36 and addressable electrode 28, while insulating them from one another.

Figure 18:
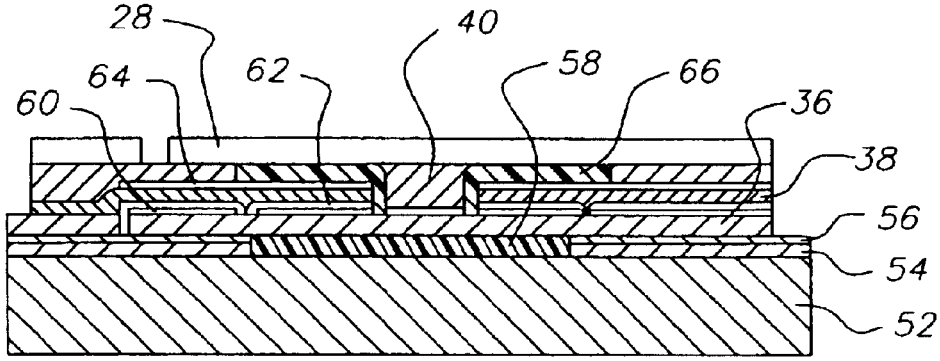
Figure 19:
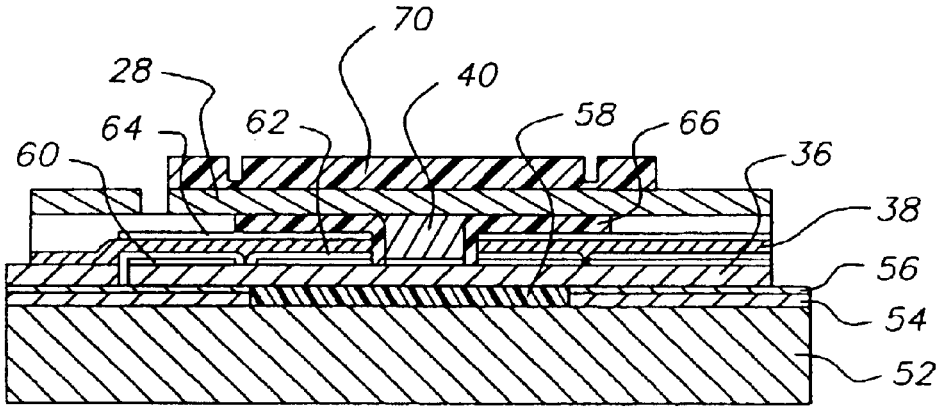

In FIG. 18, addressable electrode 28 (e.g. 2.5 μm doped polysilicon) has been deposited, patterned and etched. FIG. 19 shows the preferred embodiment after deposition, patterning, and etching of a fourth sacrificial layer 70 (e.g. 5 μm polyimide or silicon dioxide). This layer provides separation between addressable electrode 28 and nozzle plate 24 (FIG. 20) through which a drop will be ejected. The fourth sacrificial layer 70 will be eliminated later to form the liquid chamber 30. This layer is etched twice; once to provide a dimple that will create flow restrictor 46 (FIG. 8), and once to expose addressable electrode 28 for mechanical attachment. For certain layer thickness combinations, it may be necessary to planarize before this step using deposition and CMP of a sacrificial material. Otherwise, the fluid conduit may be occluded where there is no lead structure or structural support.

Figure 20:
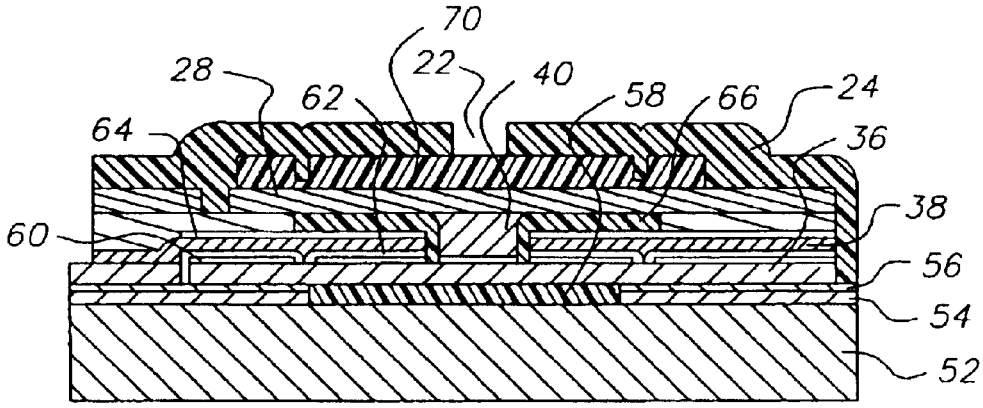
Figure 21:
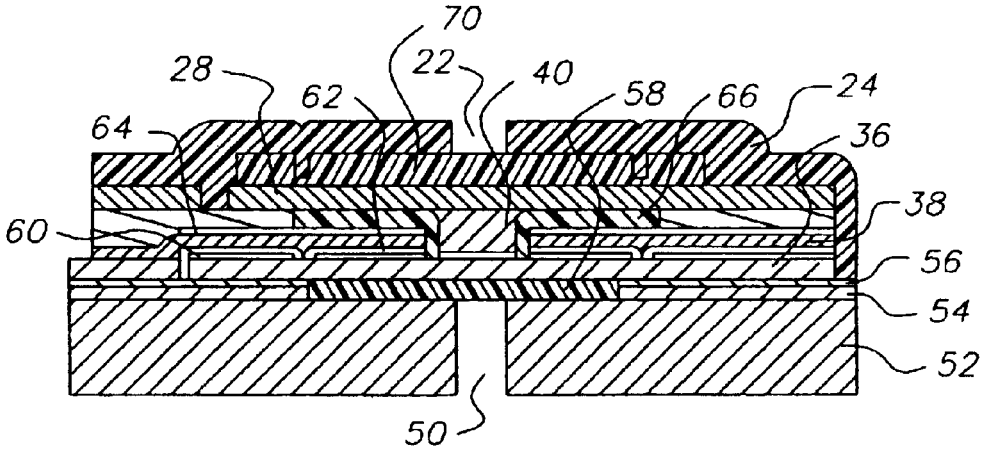

In FIG. 20, nozzle plate 24 of, for example, 4 μm nitride or polyimide (if not used for the fourth sacrificial layer) has been deposited, patterned and etched. The hole in this layer forms nozzle orifice 22 through which the drop is ejected. FIG. 21 shows the preferred embodiment after substrate 52 is etched from the back side (the side not previously patterned), opening holes to first passivation layer 56 and first sacrificial layer 58, which act as etch stops during this process.

Figure 22:
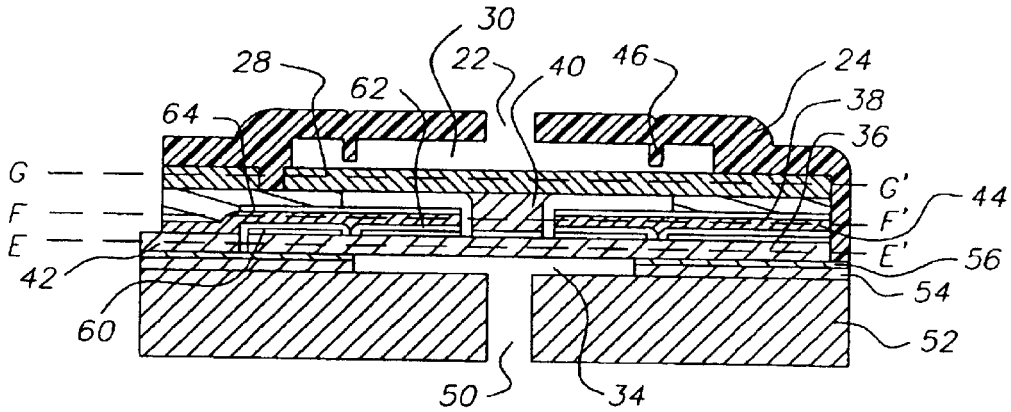
Figure 23:
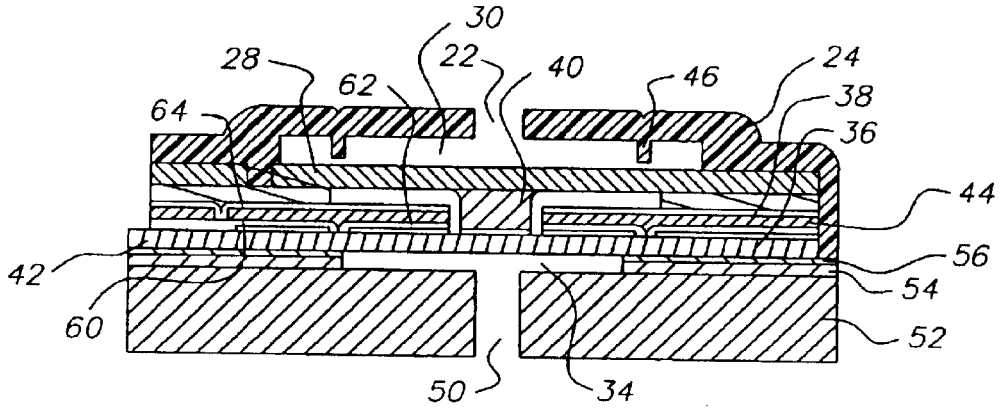
FIG. 23 shows a cross-section through B–B' of FIG. 8.
Figure 24:
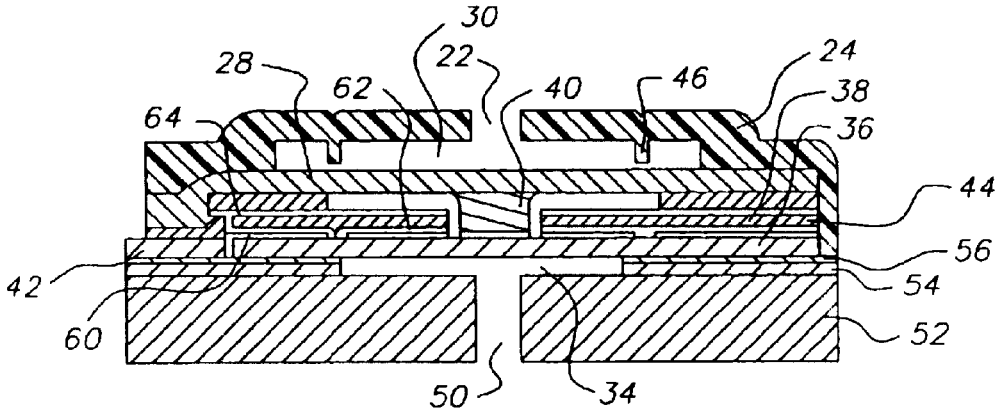
FIG. 24 shows a cross-section through C–C' of FIG. 8.

FIG. 22 shows the preferred embodiment after all sacrificial layers 58, 60, 66, 70 are removed (e.g. by immersion in HF to remove silicon dioxide sacrificial layers and/or by oxygen plasma to eliminate polyimide sacrificial layers). This is the completed device. Central electrode 38 is provided with external power through the lead 42 in this cross-section. FIG. 23 shows a cross-section through B–B' of the preferred embodiment in its finished state. The difference between this and the previous figure is the electrode structure on the left side, where addressable electrode 36 is provided with external power through lead 42 in this cross-section. FIG. 24 shows a cross-section through C–C' of the preferred embodiment in its finished state. The difference between this and the previous figure is the electrode structure on the left side, where addressable electrode 28 is provided with external power through lead 42 in this cross-section. FIG. 25 shows a cross-section through D–D' of the preferred embodiment in its finished state. The difference between this and the previous figure is that the region shown does not intersect any of the lead structure. This represents the region through which the fluid flows freely from the fluid conduit to the ejection chamber.

Figure 26:
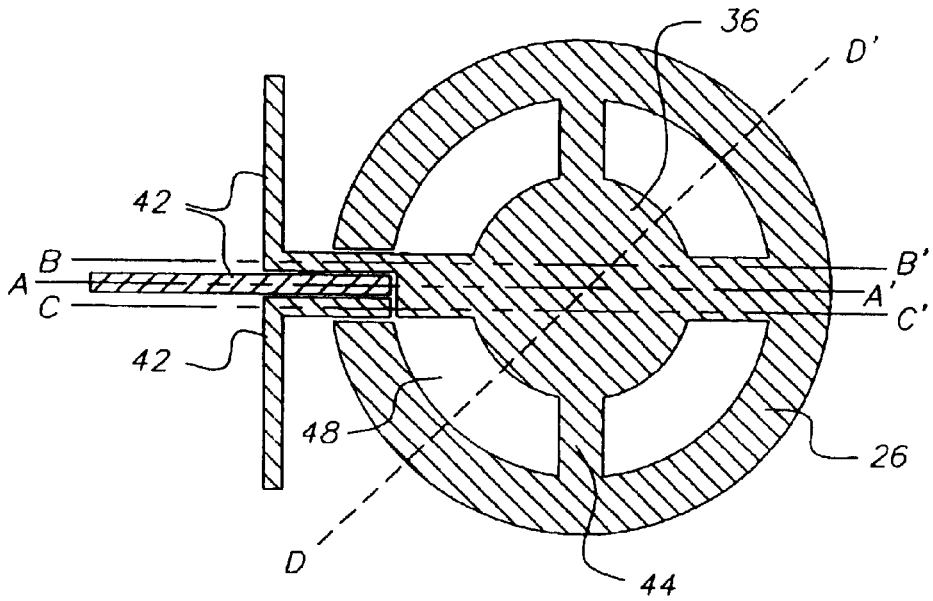
FIGS. 26–28 are cross sectional views taken through lines E–E', F–F' and G–G', respectively, of FIG. 22.
Figure 27:
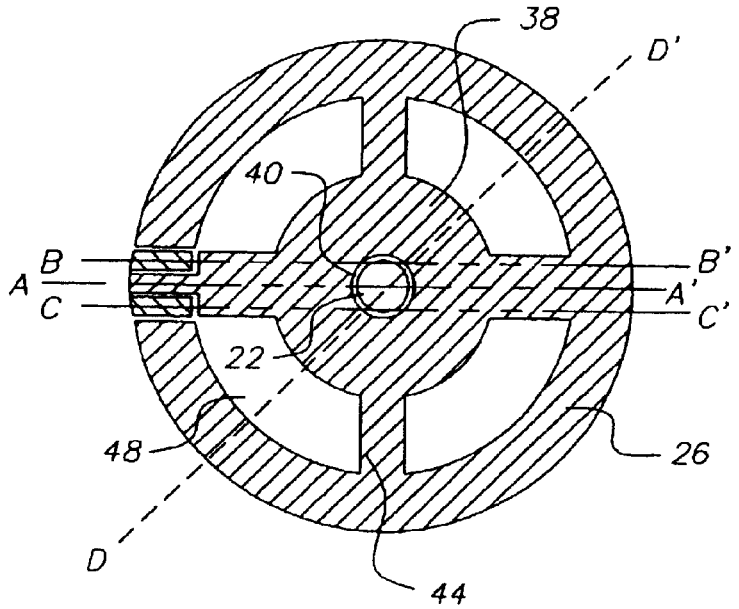
Figure 28:
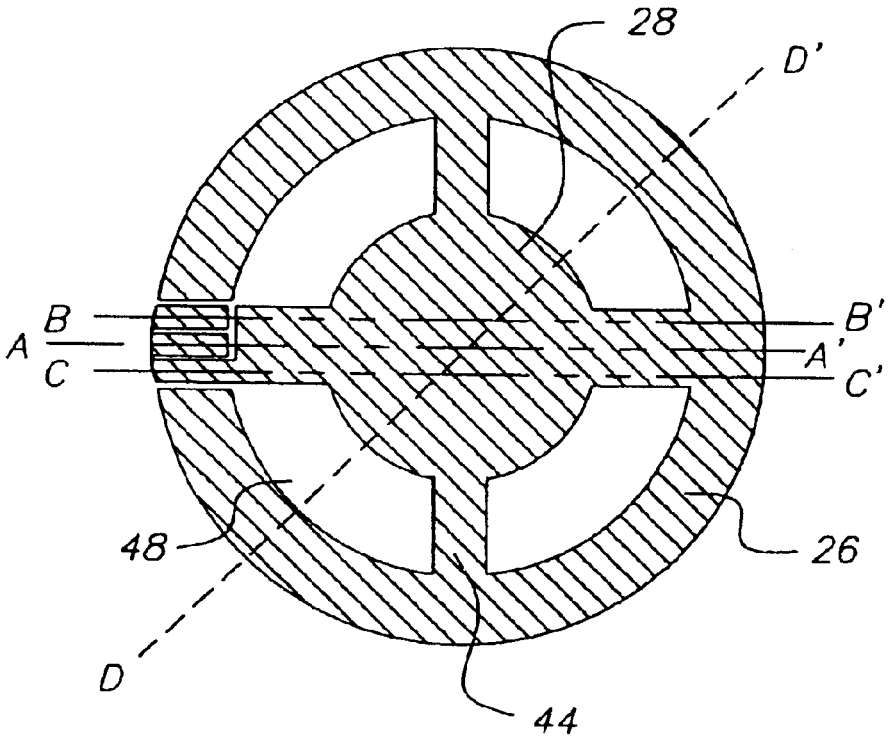

FIGS. 26–28 are cross-sectional views taken through lines E–E', F–F' and G–G', respectively, of FIG. 22.

What is claimed is:

1. A method of making a multi-layer microelectromechanical electrostatic actuator for producing drop-on-demand liquid emission devices, said method comprising:

forming an initial patterned layer (58) of sacrificial material on a substrate (52);

depositing and patterning, at a position opposed to the substrate (52), a first electrode layer (36) on the initial layer (58) of sacrificial material;

forming a subsequent patterned layer (60) of sacrificial material on the first electrode layer (36) such that a region of the first electrode layer (36) is exposed through the subsequent layer (60) of sacrificial material;

depositing and patterning, at a position opposed to the first electrode layer (36), a second patterned electrode layer (38) on subsequent layer (60) of sacrificial material;

forming a third patterned layer (66) of sacrificial material on the second electrode layer (38), said third patterned layer (66) of sacrificial material having an opening there through to the exposed region of the first electrode layer (36);

depositing and patterning a structure (68) on the third layer (66) of sacrificial material to a depth so as to at least fill the opening through the third layer (66) of sacrificial material;

planarizing structure (68) to expose a surface of the third layer (66) of sacrificial material;

depositing and patterning a third electrode layer (28) on planarized structure (68) and the exposed surface of the third layer (66) of sacrificial material, whereby the first electrode layer (36) and the third electrode layer (38) are attached by the structure (68); and removing sacrificial material from the initial layer (58), the subsequent layer (60), and the third layer (66), whereby the first electrode layer (36), the structure (68), and the third electrode layer (38) are free to move together relative to the second electrode layer (38).

2. A method as set forth in claim 1, wherein the region of the first electrode layer (36) is exposed through the subsequent layer (60) of sacrificial material by etching through the subsequent layer (60) of sacrificial material.

3. A method as set forth in claim 1, wherein the initial sacrificial layer (58) is formed by conformal deposition and planarization by chemical mechanical polishing of a sacrificial material.

4. A method as set forth in claim 1, wherein the opening through the third layer (66) of sacrificial material to the exposed region of the first electrode layer (36) is formed by etching.

* * * * *